US005744226A

United States Patent [19]

Olmstead et al.

[11] Patent Number: 5,744,226

[45] Date of Patent: Apr. 28, 1998

[54] MULTILAYERD THERMAL TRANSFER MEDIUM FOR MATTE FINISH PRINTING

[75] Inventors: Michael W. Olmstead, West Carrollton; Thomas C. Miller, Jr., Kettering; Thomas J. Obringer, Vandalia, all of Ohio

[73] Assignee: NCR Corporation, Dayton, Ohio

[21] Appl. No.: 671,050

[22] Filed: Jun. 27, 1996

[51] Int. Cl.[6] ..... B41M 5/26

[52] U.S. Cl. ..... 428/212; 427/152; 428/195; 428/341; 428/480; 428/484; 428/488.1; 428/522; 428/913; 428/914

[58] Field of Search ..... 427/152; 428/195, 428/212, 484, 488.1, 488.4, 913, 914, 341, 480, 522

[56] References Cited

U.S. PATENT DOCUMENTS

| | | | |
|---|---|---|---|
| 3,663,278 | 5/1972 | Blose et al. | 428/195 |
| 4,315,643 | 2/1982 | Tokunaga et al. | 503/226 |
| 4,403,224 | 9/1983 | Wirnowski | 346/1.1 |
| 4,463,034 | 7/1984 | Tokunaga et al. | 427/256 |
| 4,628,000 | 12/1986 | Talvalkar et al. | 428/341 |
| 4,687,701 | 8/1987 | Knirsch et al. | 428/216 |
| 4,698,268 | 10/1987 | Ueyama | 428/484 |
| 4,707,395 | 11/1987 | Ueyama et al. | 428/212 |
| 4,777,079 | 10/1988 | Nagamoto et al. | 428/212 |
| 4,778,729 | 10/1988 | Mizobuchi | 428/484 |
| 4,880,324 | 11/1989 | Sato et al. | 400/241 |
| 4,894,283 | 1/1990 | Wehr | 428/341 |
| 4,923,749 | 5/1990 | Talvalkar | 428/341 |
| 4,925,731 | 5/1990 | Hanada et al. | 428/336 |
| 4,988,563 | 1/1991 | Wehr | 428/341 |
| 5,240,781 | 8/1993 | Obata et al. | 428/488.4 |
| 5,348,348 | 9/1994 | Hanada et al. | 283/91 |

*Primary Examiner*—Bruce H. Hess
*Attorney, Agent, or Firm*—Richard J. Traverso

[57] ABSTRACT

A thermal transfer medium which forms images having a matte finish is provided which comprises a substrate, a thin first coating and a thick second coating. The coatings are formulated such that only the second coating transfers to a receiving substrate upon exposure to a thermal print head leaving the first coating positioned on the substrate. Separation of the two coatings provides images with a matte finish. The first coating has a higher softening point than the second coating and in preferred embodiments, the binder resin in the first coating provides higher adhesion to the substrate than the binder resin in the second coating.

11 Claims, 1 Drawing Sheet

MULTILAYERD THERMAL TRANSFER MEDIUM FOR MATTE FINISH PRINTING

FIELD OF THE INVENTION

The present invention relates to thermal transfer printing technology wherein data or images are produced on a receiving substrate by selectively transferring portions of a pigmented layer from a donor film to the receiving substrate by heating extremely precise areas with thin film resistors.

BACKGROUND OF THE INVENTION

Thermal transfer printing is widely used in special applications such as in the printing of machine readable bar codes, either on labels or directly on articles to be encoded. The thermal transfer process employed by these printing methods provides great flexibility in generating images allowing for broad variation in the style, size and color of the printed images, typically from a single machine with a single thermal print head.

Representative documentation in the area of thermal transfer printing include the following patents:

U.S. Pat. No. 3,663,278, issued to J. H. Blose et al. on May 16, 1972, which discloses a thermal transfer medium having a coating composition of cellulosic polymer, thermoplastic resin, plasticizer and a "sensible" material such as a dye or pigment.

U.S. Pat. No. 4,315,643, issued to Y. Tokunaga et al. on Feb. 16, 1982, discloses a thermal transfer element comprising a foundation, a color developing layer and a hot melt ink layer. The ink layer includes heat conductive material and a solid wax as a binder material.

U.S. Pat. No. 4,403,224, issued to R. C. Winowski on Sep. 6, 1983, discloses a surface recording layer comprising a resin binder, a pigment dispersed in the binder, and a smudge inhibitor incorporated into and dispersed throughout the surface recording layer, or applied to the surface recording layer as a separate coating.

U.S. Pat. No. 4,463,034, issued to Y. Tokunaga et al. on Jul. 31, 1984, discloses a heat-sensitive magnetic transfer element having a hot melt or a solvent coating.

U.S. Pat. No. 4,628,000, issued to S. G. Talvalkar et al. on Dec. 9, 1986, discloses a thermal transfer formulation that includes an adhesive-plasticizer or sucrose benzoate transfer agent and a coloring material or pigment.

U.S. Pat. No. 4,687,701, issued to K. Knirsch et al. on Aug. 18, 1987, discloses a heat sensitive inked element using a blend of thermoplastic resins and waxes.

U.S. Pat. No. 4,698,268, issued to S. Ueyama on Oct. 6, 1987, discloses a heat resistant substrate and a heat-sensitive transferring ink layer. An overcoat layer may be formed on the ink layer.

U.S. Pat. No. 4,707,395, issued to S. Ueyama et al. on Nov. 17, 1987, discloses a substrate, a heat-sensitive releasing layer, a coloring agent layer, and a heat-sensitive cohesive layer.

U.S. Pat. No. 4,777,079, issued to M. Nagamoto et al. on Oct. 11, 1988, discloses an image transfer type thermosensitive recording medium using thermosoftening resins and a coloring agent.

U.S. Pat. No. 4,778,729, issued to A. Mizobuchi on Oct. 18, 1988, discloses a heat transfer sheet comprising a hot melt ink layer on one surface of a film and a filling layer laminated on the ink layer.

U.S. Pat. No. 4,894,283, issued to Wehr on Jan. 16, 1990, discloses a reusable thermal transfer ribbon with a functional layer and a binding layer containing 100% ethylene vinyl acetate copolymer.

U.S. Pat. No. 4,923,749, issued to Talvalkar on May 8, 1990, discloses a thermal transfer ribbon which has a thermal sensitive layer and a protective layer which is water based.

And, U.S. Pat. No. 4,988,563, issued to Wehr on Jan. 29, 1991, discloses a thermal transfer ribbon having a thermal sensitive coating and a protective coating. The protective coating is a wax-copolymer mixture which reduces ribbon offset.

The printed image obtained from a thermal transfer ribbon is normally very glossy. This glossiness is often a very welcomed characteristic, as a glossy image is generally perceived to be darker. However, when this thermal transfer ribbon is used to print on substrates such as plain paper, glossy print can sometimes make it difficult to read. It is for this reason that a non-glossy, or "matte" finish is desired when printing a ribbon designed for plain paper. Thermal transfer facsimile machines or "plain paper" facsimile machines require such a ribbon.

The surface of the printed image from a thermal transfer ribbon is such that it is a "mirror image" of the substrate surface of the thermal transfer ribbon. Therefore, where the functional layer of the thermal transfer ribbon is coated on a very smooth polyester film, the surface of the printed image will appear to be very smooth or glossy upon complete transfer of the functional layer from the film to the paper.

To give the printed image a matte, or "flat", appearance, a good film split of the functional layer is desired. Film split can be generally defined as an incomplete transfer of the functional layer. Some of the functional layer remains on the substrate of the thermal transfer ribbon of the printing while the rest has transferred. This film split results in an uneven surface for the transferred functional layer and a non-glossy appearance. It is very difficult, however, to control how much coating is left on the film. Also, since the functional layer is essentially being torn apart, good print quality (resolution) is difficult to obtain.

SUMMARY OF THE INVENTION

It is an object of the present invention to provide a thermal transfer medium such as a thermal transfer ribbon which provides high quality images with a matte finish.

It is another object of the present invention to provide a thermal transfer medium such as a thermal transfer ribbon which provides high quality images with a matte finish using conventional processing equipment and thermal transfer printing apparatus.

Additional objects and advantages of the present invention will become apparent and further understood from the detailed description and claims which follow, together with the annexed drawings.

The above objects are achieved through the thermal transfer medium of the present invention which comprises a) a flexible substrate; b) a thermally sensitive first coating composition on said substrate having a coat weight of from 1 to 5 mg/4 $in^2$ and comprising a pigment, a binder resin and solvent; and c) a thermally sensitive second coating positioned on said first coating having a coat weight of from 5 to 15 mg/4 $in^2$ and containing a colorant, a binder resin, wax and solvent. The first coating and second coating are formulated so that the first coating has a softening point higher than that of the second coating. In addition, the first coating has at least 40 weight percent binder resin, based on dry components and the second coating has at least 40 weight percent wax based on dry components. In preferred embodiments, the first coating contains at least 50 weight percent resin binder and less than 50 weight percent wax to enhance adhesion to the flexible substrate.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
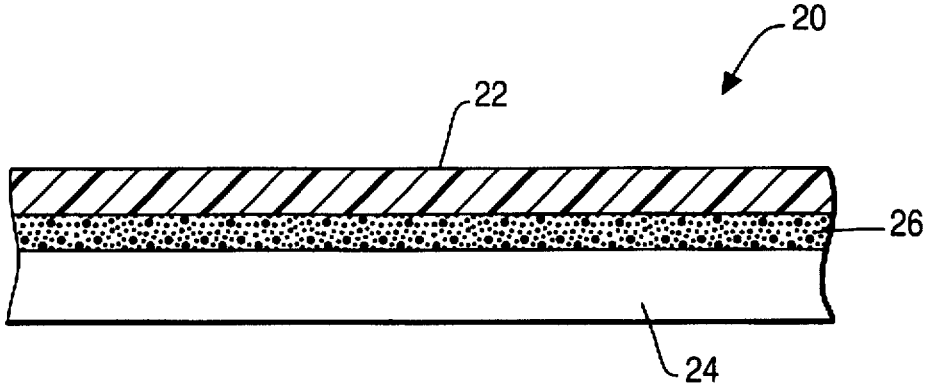
FIG. 1 illustrates a thermal transfer medium of the present invention prior to thermal transfer.
Figure 2:
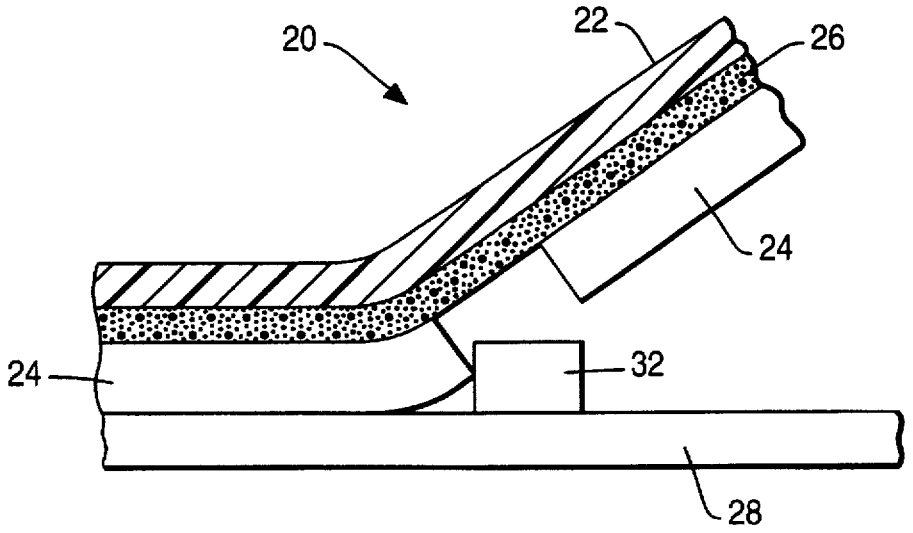
FIG. 2 illustrates a thermal transfer medium of the present invention after thermal transfer.

Thermal transfer ribbon 20, as illustrated in FIGS. 1 and 2, is a preferred embodiment of this invention comprising a substrate 22 of a flexible material, preferably a thin smooth paper or plastic-like material. Tissue-type paper material or polyester-type plastic materials are preferred. Positioned on substrate 22 is a first coating 26 also referred to herein as an "undercoating." The first coating contains a binder resin, a pigment, a solvent and optionally wax. The thermal transfer ribbon 20 also has a thermally sensitive second coating 24 positioned on first coating 26 which contains a binder resin, colorant, wax and a solvent. The softening point of the first coating is higher than that of the second coating. The first coating 26 contains at least 40 weight percent binder resin, based on the total dry ingredients. The first coating contains more binder and less wax than the second coating. The second coating contains at least 40 weight percent wax based on the total dry ingredients. The thermal sensitivity of the first coating 26 and second coating 24 is determined by the melting point of the binder resin and wax and the amount of each therein. The variations in coating composition and melting points are such that exposure to heat from a thermal transfer head will transfer only second coating 24 to a receiving substrate 28. The first and second coatings separate upon transfer, forming a single layer image 32.

The binder resins in the first and second coatings are preferably distinct so as to ensure only the second coating responds and transfers to the receiving substrate upon being heated by a thermal print head. The coatings can be further differentiated by the colorants, waxes and solvents used and the amounts thereof. Providing a dual layer thermal transfer medium has been found to be advantageous in providing high quality images with a matte finish. The first coating creates a non-glossy surface for the second coating which causes the second coating to have a matte appearance when applied to a receiving substrate.

The first coating contains a pigment such as carbon black at levels typically lower than that of the second coating since it is intended that the first coating not transfer and form part of the sensible image. The pigment functions more as a filler in the first coating. The amount preferably ranges from 5 to 15 weight percent based on the total dry ingredients of the coating and most preferably about 10 weight percent of the total dry ingredients of the coating. Essentially, any pigment suitable for use in thermal transfer printing can be employed in the first coating. A preferred pigment is carbon black.

The second coating is a functioning layer and contains a colorant so as to be sensed visually. Essentially, any colorant suitable for use in thermal transfer printing can be employed in the second coating. These include pigments which can be sensed by optical, magnetic or electronic means. An example is carbon black. The term "colorants" as used herein includes organic dyes such as those described in U.S. Pat. No. 3,663,278 and leuco dyes which can react with phenolic resins to generate color. The second coating typically contains a loading of colorant higher than the first coating since unlike the first coating, it is to be transferred and sensed by optical, magnetic or electronic means. The distinct loading of colorant also helps differentiate the two coatings so that they separate and do not transfer simultaneously upon exposure to a thermal print head. Amounts of 10–85 wt % can be used in the second coating. To help differentiate the two coatings and avoid simultaneous transfer, distinct colorant may be used in each coating. Most preferably, the second coating contains carbon black at a level of about 15 to 25 weight percent based on the total weight of dry ingredients of the coating. It should be realized that the second coating may contain colorants other than colored pigments such as magnetic pigments or fluorescent pigments for specialized applications.

The binder resin used in the first coating and second coating must be distinct so as to provide distinct softening characteristics. This assists in transfer of only the second coating to a receiving substrate upon application of heat from a thermal print head. The softening/melting point of the binder resin within the first coating is preferably higher than that of the second coating.

The binders have many requirements in addition to providing distinct thermal sensitivities such as providing flexibility or resiliency for the coatings. The binder for the first coating preferably provides high adhesion to a substrate. Latexes such as EC 1052 Latex by Environmental Inks and Coatings has been found to provide significant adhesion to the polyester substrates. The resin binder of the second coating preferably provides high adhesion to the receiving substrate once the second coating is transferred. Suitable binder resins for the first and second coatings are well known and include those described in U.S. Pat. Nos. 5,240,781 and 5,348,348. Suitable binder resins include an acrylic acidethylene-vinyl acetate terpolymer, methacrylic acid-ethylene-vinyl acetate terpolymer, acrylic acid-ethylene-ethylacetate terpolymer, and other (meth)acrylic acid alkyene alkyl acetate terpolymers, polyvinylchloride, polyvinyl acetate, vinylchloride-vinyl acetate copolymer, polyethylene, polypropylene, ethylene-vinyl acetate copolymer, ethylene-ethyl acetate copolymer, styrene copolymer, nitrile rubber, acrylic rubber, ethylene-propylene rubber, polyurethane resin, ethylenealkyl (meth)acrylate copolymer, polyvinyl alcohol, and styrene-alkyl (meth) acrylate copolymer. These resins preferably have a softening temperature of from 80° C. to 250° C.

The binder resins can be soluble in water or organic solvents or be dispersible in these solvents. To obtain dispersions, the binder resins are typically used as small particles, typically of submicron size. Each coating may contain more than one binder resin to provide a specific property profile for the resulting coating. For example, Picotex 100 resin by Hercules is a hydrocarbon resin (vinyl toluene-α-methylstyrene copolymer) that provides hot tack properties desirable for the second coating in aiding adhesion to the receiving substrate upon transfer. Another binder resin suitable for the second coating is ethyl vinyl acetate copolymer such as "Elvax 260" by Chemcentral of Atlanta, Ga. With respect to the amount of binder resin, the first coating contains at least 40 weight percent resin binder and preferably from 50 to 85 weight percent resin binder. In contrast, the second coating preferably contains less than 40 weight percent resin binder and most preferably less than 25 weight percent resin binder.

The second coating also contains wax such as hydrocarbon wax, paraffin wax, carnauba wax, etc. Suitable waxes are those used in conventional thermal transfer media including those described in U.S. Pat. No. 5,240,781. Suitable waxes provide temperature sensitivity and flexibility. Examples include natural waxes such as carnauba wax, rice wax, bees wax, lanolin, candelilla wax, motan wax and ceresine wax; petroleum waxes such a paraffin wax and microcrystalline waxes; synthetic waxes such as oxidized wax, ester wax, low molecular weight polyethylene and Fisher-Tropsch wax; higher fatty acids such as lauric acid, myristic acid, palmitic acid, stearic acid and behenic acid; higher aliphatic alcohols such as stearyl alcohol; esters such as sucrose fatty acid esters, sorbitan fatty acid esters and amides. The wax-like substances preferably have a melting point of from 40° C. to 130° C., more preferably 65° C. to 110° C. A particular example of a suitable wax is carnauba wax provided by Shamrock Technologies in Newark, N.J. under the tradename "S-Nauba". Another is "Carnauba North Country No. 3" by Baldini & Co., Inc. of Millburn, N.J. The first coating may optionally contain a wax and the amount thereof is typically less than that in the second coating. It is preferable to utilize waxes with a higher softening temperature than that of the wax within the second coating to further differentiate the coatings and provide a higher softening temperature for the first coating in general. Suitable waxes for the first coating include those described above including "S-Nauba" by Shamrock Technologies, Inc. referred and also polyethylene wax available from Micro Powders, Inc. of Tarrytown, N.Y. under the tradename "MPP-620XF". The first coating preferably contains less than 45 weight percent wax. In contrast, the second coating contains at least 40 weight percent wax and most preferably from 50 to 85 weight percent wax. A preferred thermal transfer medium contains a polyester substrate with a first coating comprising from 5 to 15 weight percent pigment, 0 to 45 weight percent wax and 50 to 85 weight percent binder resin. The second coating comprises 15 to 25 weight percent colored pigment, 50 to 80 percent wax and 5 to 15 weight percent resin binder.

The first and second coatings may contain a plasticizer to enhance flexibility and reduce the softening point. Plasticizers used in binders of conventional thermal transfer ribbons such as those described in U.S. Pat. No. 3,663,278 are suitable as are poly(ethylene oxide) homopolymers such as Polyox N10 water soluble resins by Union Carbide. Each layer may contain other optional additives to enhance such properties as flexibility, softening, viscosity and smoothness. These optional additives include plasticizers such as adipic acid esters, phthalic acid esters, chlorinated biphenyls, citrates, epoxides, glycerols, glycols, hydrocarbons, chlorinated hydrocarbons, phosphates, and the like. Other optional additives include flexibilizers such as oil, weatherability improvers such as U.V. light absorbers and fillers.

The thermal transfer medium of the present invention can be produced by a two-layer process wherein the first coating is applied to a substrate such as a polyester film as an undercoating and the second coating applied over the first. The coating weight of the undercoat is preferably maintained between 1 to 5 mg/4in$^2$, the second coating is typically applied at a level from 5 to 15 mg/4in$^2$, preferably 9 to 15 mg/4in$^2$. The polyester film is typically from 18 to 24 gauge; however, the substrates can vary widely and include those described in U.S. Pat. No. 5,348,348. The proportion of binder resin and wax within the coating can be adjusted to control their softening temperature. Preferred second coatings soften at a temperature in the range of about 50° C. to 250° C. which enables transfer of the second coating at normal print head energies which range from 100° C. to 300° C. and more typically, 200° C. to 300° C. In addition to manipulation of the proportion of binder resin, wax and pigments, additives may be introduced to manipulate the softening point or other properties such as smear resistance, image quality and scratch resistance.

The thermal transfer media of this invention are prepared from formulations that contain the above components in solution or dispersion, typically at about 10 to 60 weight percent solids, preferably 10 to 25 weight percent solids. A portion of the solvents remain in the coating applied. The coating formulation can be based on aqueous solvents or organic solvents.

These coating formulations are applied to substrates by conventional techniques and equipment such as Meyer Rod® or like wire round doctor bar set up on a conventional coating machine to provide the coating weights described above. The first coating is typically applied at a temperature higher than the second coating. Once the first coating is applied, it is dried before application of the second coating. The second coating is applied and dried in a similar manner to the first coating. The temperature of the driers are typically in the range of 150° F. to 200° F.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

The entire disclosure of all applications, patents and publications, cited above and below, are hereby incorporated by reference.

EXAMPLE 1

A first coating formulation was obtained by preparing the following solution.

First Coating Formulation

| Component | Dry % | Dry Batch | Wet Batch | Range Dry |
|---|---|---|---|---|
| Latex[1] | 50 | 100 | 250 | 50–85 |
| Carbon Black | 10 | 20 | 20 | 5–15 |
| Carnauba Wax[2] | 20 | 40 | 40 | 0–25 |
| Polyethylene Wax[3] | 20 | 40 | 40 | 0–25 |
| Water | — | — | 550 | — |
| Isopropyl Alcohol | — | — | 100 | — |
| TOTAL | 100.0 | 200.0 | 1000 | |

[1]Latex = "EC 1052 Latex" by Environmental Inks and Coatings, Morganton, NC.
[2]Carnauba Wax = "S-Nauba" by Shamrock Technologies, Inc., Newark, NJ.
[3]Polyethylene Wax = "MPP-620XF" by Micro Powders, Inc. Tarrytown, NY.

A second coating formulation was obtained by preparing the following solution:

Second Coating Formulation

| Component | Dry % | Dry Batch | Wet Batch | Range Dry |
|---|---|---|---|---|
| Ethyl Vinyl Acetate Copolymer[4] | 8.3 | 8.3 | 8.3 | 5–15 |
| Carbon Black | 18 | 18 | 18 | 15–25 |
| Carnauba Wax[5] | 5.6 | 5.6 | 5.6 | 0–15 |
| Paraffin Wax[6] | 38.9 | 38.9 | 38.9 | 35–60 |
| Hydrocarbon Wax[7] | 29.2 | 29.2 | 29.2 | 20–40 |
| Mineral Spirits | — | — | 400 | — |
| TOTAL | 100.0 | 100.0 | 500.0 | — |
| FINAL SOLIDS % | 16.7 | | FINAL SOLIDS % | 15–30 |

[4]Ethyl Vinyl Acetate Copolymer = "Elvax 260" by Chemcentral, in Atlanta, GA.
[5]Carnauba Wax = "Carnauba North County, Number 3" by Baldini & Co., Inc., in Millburn, NJ.
[6]Paraffin Wax = "Paraffin 1014" by IGI-Boler, in Wayne, PA.
[7]Hydrocarbon Wax = "WB-17" by Petrolite Corp., in Tulsa, OK.

Example of a Thermal Transfer Medium

A thermal transfer medium consistent with the present invention is prepared as follows: A first coating is formed on a 4.5 micron polyester film by I. E. DuPont Demeres & Co. having a weight between 1–5 mg/4in$^2$ from the First Coating Formulation described above. A second coating having a weight controlled between 5 to 15 mg/4in$^2$ is deposited on the first coating from the Second Coating Formulation described above. The coated polyester film is dried following the application of each coating.

The preceding examples can be repeated with similar success by substituting the generically or specifically described reactants and/or operating conditions of this invention for those used in the preceding example.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A thermal transfer medium which consists essentially of:

a flexible substrate, a first coating positioned on said substrate having a coat weight of from 1 to 5 mg/4 in$^2$ and comprising pigment and at least 40 weight percent of a binder resin, based on dry components; and a thermally sensitive second coating positioned on said first coating having a coat weight of from 5 to 15 mg/4 in$^2$ and comprising colorant, a binder resin distinct from binder resin of the first coating and at least 40 weight percent wax, based on the dry components;

wherein the first coating has a softening point higher than that of the second coating so as to provide for transfer of the second coating without the first coating to a receiving substrate upon application of heat by a thermal transfer print head.

wherein the second coating is transferred in an amount sufficient so as not to permit reuse of said second coating.

2. A thermal transfer medium as in claim 1, wherein the first coating additionally contains wax in an amount less than 45 weight percent, based on dry components.

3. A thermal transfer medium as in claim 2, wherein the first coating contains from 5 to 15 weight percent pigment, 0 to 45 weight percent wax and 50 to 85 weight percent binder resin based on dry components and the second coating comprises 5 to 25 weight percent colorant, 5 to 15 weight percent binder resin and 60 to 80 weight percent wax based on dry components.

4. A thermal transfer medium as in claim 1, wherein the second coating is completely transferred to a receiving substrate upon application of heat by a thermal transfer print head.

5. A thermal transfer ribbon which provides images with a matte finish, said thermal transfer ribbon consisting essentially of:

a polyester substrate, a thermally sensitive first coating positioned on said substrate having a coat weight of less than 3 mg/4 in$^2$ and comprising 5 to 15 weight percent pigment, based on dry components, at least 40 weight percent of a latex binder resin, each based on dry components and from 0 to 45 weight percent wax, based on dry components; and a thermally sensitive second coating positioned on said first coating having a coat weight of from 5 to 15 mg/4 in$^2$ comprising 5 to 25 weight percent colorant, 5 to 15 weight percent binder resin distinct from the binder resin of the first coating and 60 to 80 weight percent wax, each based on dry components;

wherein the first coating has a softening point higher than that of the softening point of the second coating so as to provide for transfer of the second coating without the first coating to a receiving substrate upon application of heat by a thermal transfer print head.

wherein the second coating is transferred in an amount sufficient so as not to permit reuse of said second coating.

6. A thermal transfer ribbon as in claim 5, wherein the wax employed in the first coating has a higher melting temperature than the wax within the second coating.

7. A thermal transfer ribbon as in claim 5, wherein the latex binder resin within the first coating adheres to the polyester substrate.

8. A thermal transfer ribbon as in claim 7, wherein the latex binder resin within the second coating comprises ethyl vinyl acetate copolymer.

9. A thermal transfer ribbon as in claim 5, wherein the pigment within the first coating and second coating is carbon black and the wax within the first coating is polyethylene wax.

10. A thermal transfer ribbon as in claim 5, wherein the second coating transfers to a receiving substrate upon the application of heat by a thermal print head operating at a temperature in the range of 200° C. to 300° C.

11. A thermal transfer ribbon consisting essentially of a polyester substrate;

a first coating positioned on said substrate having a coat weight of from 1 to 3 mg/4 in$^2$ and comprising 5 to 15 weight percent carbon black, based on dry components, 0 to 25 weight percent carnauba wax, based on dry components, 0 to 25 weight percent polyethylene wax, based on dry components and 15 to 85 weight percent latex binder resin based on dry components; and a second coating positioned on said substrate having a coat weight of from 5 to 15 mg/4 in$^2$ comprising 15 to 25 weight percent carbon black, 0 to 15 weight percent carnauba wax, 30 to 60 weight percent paraffin wax and 20 to 40 weight percent hydrocarbon wax and 5 to 15 weight percent ethyl vinyl acetate copolymer, each based on dry components;

wherein the first coating has a softening point higher than the second coating so as to provide for transfer of the second coating to a receiving substrate upon the application of heat by a thermal print head operating at a temperature in the range of 200° C. to 300° C. wherein the second coating is transferred in an amount sufficient so as not to permit re-use of said second coating.

* * * * *